United States Patent [19]

Cislo

[11] Patent Number: 4,788,838

[45] Date of Patent: Dec. 6, 1988

[54] GUARDIAN LOCKBOX FOR PISTOLS

[76] Inventor: Daniel M. Cislo, 10507 Tennessee Ave., Los Angeles, Calif. 90064

[21] Appl. No.: 19,518

[22] Filed: Feb. 26, 1987

[51] Int. Cl.[4] ..... E05B 65/52

[52] U.S. Cl. ..... 70/63; 5/503; 5/507; 70/69

[58] Field of Search ..... 70/63, 69–76; 5/503, 507, 508

[56] References Cited

U.S. PATENT DOCUMENTS

| | | | |
|---|---|---|---|
| 2,755,748 | 7/1956 | Abell | 70/63 |
| 3,036,758 | 5/1962 | Greenbank | 70/63 |
| 4,474,116 | 10/1984 | Castenade | 70/63 |
| 4,532,783 | 8/1985 | Maurice | 70/63 |
| 4,573,332 | 3/1986 | Ma | 70/67 |

FOREIGN PATENT DOCUMENTS

| | | | |
|---|---|---|---|
| 1032266 | 3/1983 | France | 70/69 |

*Primary Examiner*—Robert L. Wolfe

[57] ABSTRACT

A means to lock a handgun within a compartment while the compartment is readily lockable to a standard bedframe without interfering with the position of a box spring or mattress. The compartment is only accessible by selecting a particular code which unlocks a latch to open the compartment. The latch can be lighted to allow the selecting of the proper code at night.

11 Claims, 2 Drawing Sheets

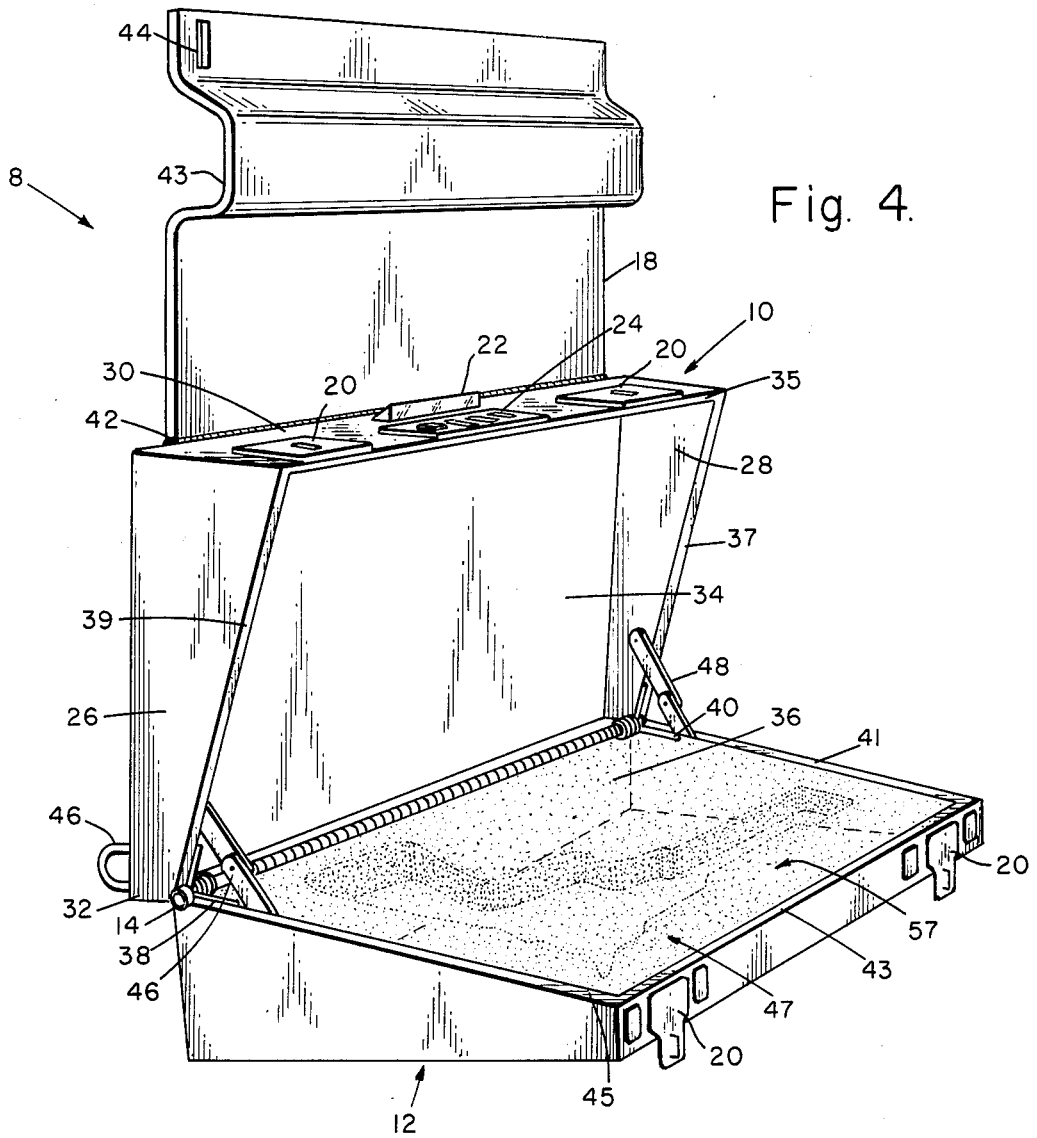
Fig. 4.
Fig. 5.
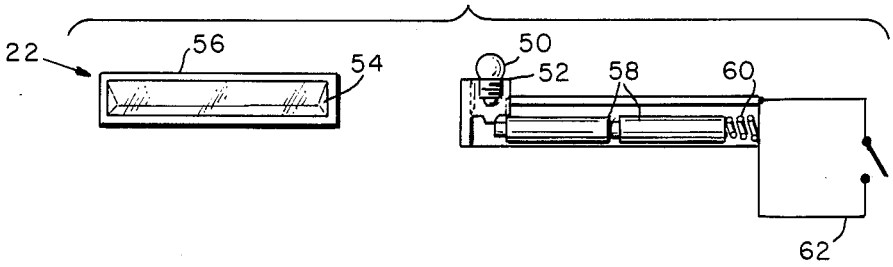

GUARDIAN LOCKBOX FOR PISTOLS

This invention relates generally to handgun safety mechanisms, and, more particularly, to a handgun lockbox for securely storing a handgun while still making it accessible.

Handgun safety mechanisms vary in type, complexity, and effectiveness. Such mechanisms typically comprise locking means which fit around the trigger guard of a handgun. The locking means prevents access to the trigger and locks the trigger in a set position relative to the handgun's trigger guard. For many guns, this effectively prevents the trigger and hence the hammer or firing means from moving and thus prevents accidental firing of the weapon when the mechanism is properly used. However, other handguns have firing pins or hammers which if jarred can accidentally fire the weapon in the event it is loaded. Therefore, use of these locking mechanisms for safely storing a handgun is only advisable if the gun is unloaded. Additionally, these mechanisms are locked and unlocked by the use of a key which must be available to access the gun. Usually the key is located in a different area for security reasons.

In the event an intruder disturbs the slumber of a hangun owner at night, the handgun so protected is of little use. The owner would have to locate the key to the locking mechanism, unlock the locking mechanism (by fumbling around in the dark or turning on a light), load the pistol with ammunition that is probably likewise in a different location, and only then confront the intruder.

There is substantial interest in millions of handgun owners to not only safely and securely store their handguns, but also have them loaded and readily accessible in the event of an intruder, especially at night.

The features identified above as being desirable for a handgun safety device are all provided by the present invention.

SUMMARY OF THE INVENTION

The present invention is embodied in an improved handgun lockbox that can safely and securely store a loaded handgun of a variety of sizes, yet make it readily accessible in the middle of the night. The invention is extremely economical, completely effective in securing a handgun, prevents the gun from theft and can only be opended by someone with the knowledge of a predetermined code. The code can be easily selected at night by a lighted display which is activated by touch.

More particularly, the lockbox has a hinge and fastener which allows it to be locked to any standard bedframe support. This makes the lockbox literally inches away and seconds from use for anyone sleeping in the bed supported by the bedframe The person in bed need only reach over and touch the top of the lockbox which illuminates an access code pad allowing a code to be selected. Once the code is selected, a latch means can be unlocked which causes the lockbox to "pop open" exposing a loaded pistol ready for use.

In more detailed aspects of the invention, the surrounding compartment of the lockbox is made up of two wedge shaped housings forming the lockbox. The handgun is put in the lockbox such that the weight of the contained handgun causes the first housing to swing open when the lockbox is unlocked. The second housing remains securely fastened to the ordinary bedframe support. Fastening is achieved by an hasp which is free to rotate until locked into position. The hasp has a shape simliar to the 90° angle of a bed frame support. This allows the bed frame support to be firmly grasped between the hasp and the second housing while allowing a mattress to be placed over the hasp and the bedframe. This configuration effectively prevents anyone from taking the lockbox and enclosed handgun. The hasp also serves as a carrying handle when the lockbox is not locked to the bedframe support, but instead used as a handgun carrying case.

BRIEF DESCRIPTION OF THE DRAWINGS

FIG. 4 is a perspective view of the invention in an unlocked and open position with the hasp free to rotate and FIG. 5 is a cross-sectional view of the lighting means to light the access code panel.

DESCRIPTION OF THE PREFERRED EMBODIMENT

Figure 1:
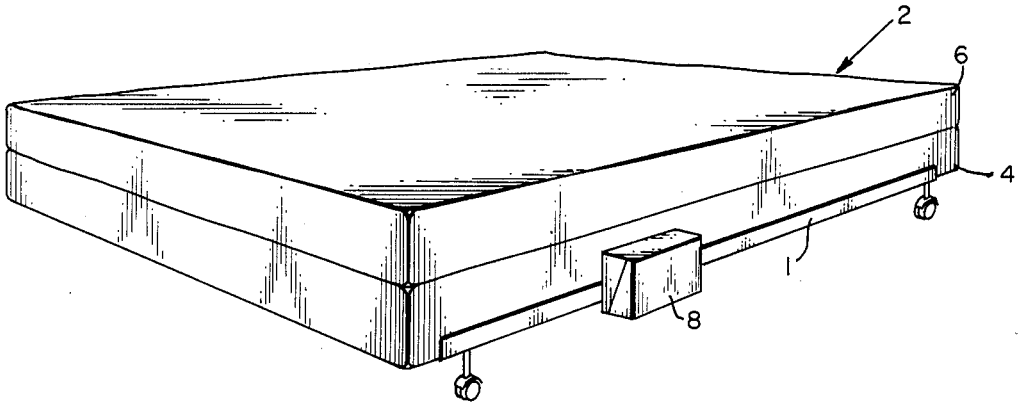
FIG. 1 is a perspective view of the invention attached to a standard bedframe support with both a box spring and a mattress in position over the bed frame support.
Figure 2:
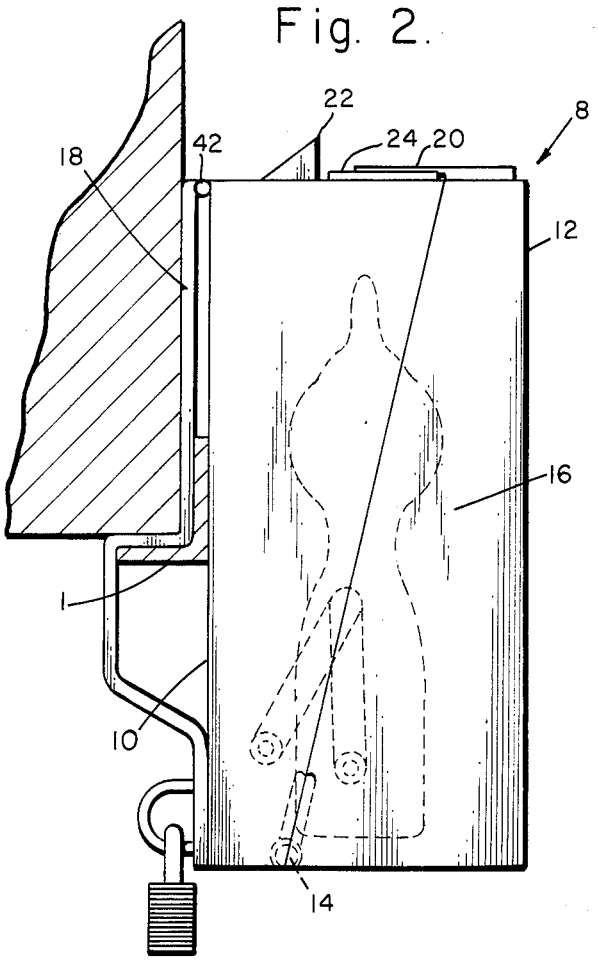
FIG. 2 is a side, elevation plan view of the invention attached to a standard bedframe, showing a handgun in phantom line.
Figure 3:
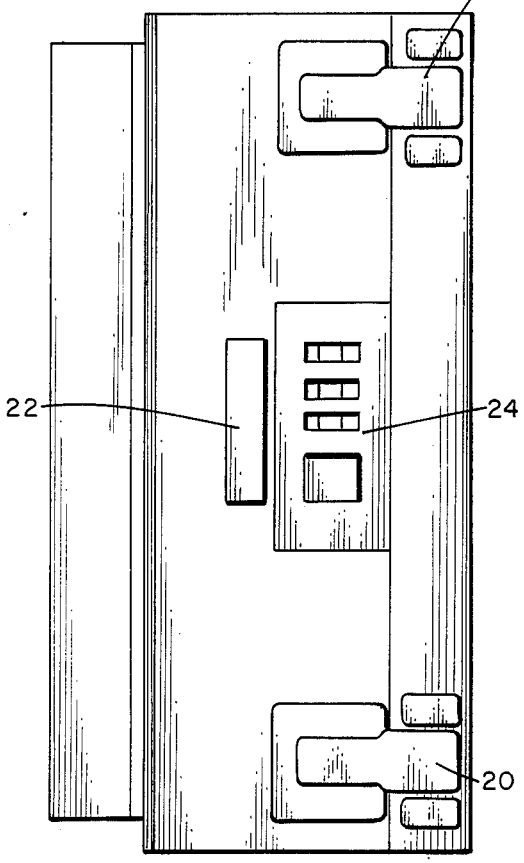
FIG. 3 is a top plan view looking down o the latching means of the invention.

Referring to the drawings wherein like numerals of relevance design like elements throughout and shown in FIG. 1 the invention is embodied in a lockbox of a kind that can be locked onto a standard bedframe support 1 to safely hold a handgun in close proximity to one lying on a bed 2. FIG. 1 shows the lockbox 8 locked on to the bedframe support 1. The box spring 4 and mattress 6 are unobstrusively placed on top of the bedframe support 1 without interference from the invention. As shown in FIG. 2, the lockbox 8 includes two wedge shaped complementary housings 10 and 12. A first housing 10 and a second housing 12 is joined by a first hinge means 14 so as to come together and form a compartment 16 within the interior of housings 10 and 12. Lockbox 8 also includes a hasp 18 hinged to the first housing 10 to lock the lockbox 8 to the bedframe support 1. The housings 10 and 12 are locked together in a closed position by a latching means 20 which ca only be operated by the user of the invention having a preselected, specific access code. A light means 22 can be activated by touch to illuminate an access code panel 24 where the access code is to be inputed. In FIG. 3, a top view of the latching means 20, access code panel 24 and lighting means 22 is illustrated In accordance with the invention, as best seen in FIG. 4, the first housing 10 comprises five panels: four sides and a bottom. Two sides 26 and 28 of first housing 10 have an almost triangular shape while the other two sides 30 and 32 have a rectangular shape. The first rectangular side 30 is wider than the second rectangular side 32 while the bottom 34 is rectangular having the greatest area of all the panels. The panels making up the sides 26, 28, 30 and 32 and bottom 34 are at right angles to their adjacent panels and are sufficiently large so when assembled together form half of a compartment in which a handgun will fit. The panels 26, 28, 30, 32 and 34 are made of a strong and durable material, preferably sheet metal, hard plastic, or made of some other material of sufficient strength so fastened together to prohibit breaking under extreme force.

The second housing 12 is of identical construction and material. The first hinge means 14 joins the first housing 10 along its smaller rectangular side 32 and the second housing 12 along its larger rectangular side 36. The housings can rotate with respect to each other around the first hinge means 14 to bring the exposed edges of all sides not in contact with another panel of both housings together. When the edges 35, 37, and 39 of the first housing 10 are in contact with the complementing edges 41, 43 and 45 of the second housing 12, an interior chamber 47 is formed of sufficient size to hold a handgun, not shown, within. When the lockbox 8 is in an upright position as shown in FIG. 2, the weight of the handgun on the second housing 12 causes the second housing 12 to rotate about the first housing 10 when the housings are not latched together. This effectively causes the lockbox 8 to "pop open" when the latching means 20 is unlocked. The "pop open" action may be accentuated by the use of tension springs 38 and 40. The tension springs 38 and 40 are held in position by the first hinge means 14 by a means commonly know in the art of tension springs. The two tension springs 38 and 40 are located along the first hinge means 14 and exert force along the two panels 32 and 36 joined by the first hinge mean 14 pushing the two housings 10 and 12 apart.

In FIG. 2 the phantom lines of a handgun show the position of the handgun within the chamber 47 formed by both housings 10 and 12. Also, shown in FIG. 2 is the hasp 18 joined by a second hinge means 42 to an edge formed by the bottom 34 and the larger rectangular side 30 of the first housing 10. As shown in FIG. 4 the hasp 18 is free to rotate around the second hinge means 42 so as to be positioned around the bed support frame 1 or removed from the bed support frame 1. The hasp 18 is of a contoured shape to allow it to come in contact with the bed support frame 1 touching and holding the frame between the hasp 18 and the first housing 10. The hasp 18 is bent at its midsection 43 such that it makes a right angle midway along its length and then slopes to a position in line with its initial length. The hasp 18 has a slot 44 on its end which mates with a loop 46 which protrudes outwardly from the bottom of the first housing 10 and positioned so as to mate with the hasp's slot 44. The loop 46 is located in such a position that the hasp 18 can be rotated about the second hinge means 42 until it comes in contact with the bottom of the first housing 10. When mated the slot 44 of the hasp 18 allows the loop 46 to be exposed beyond the hasp 18. A combination or keyed lock (not shown) may be locked on to the loop 46 securely preventing the hasp 18 from disengaging the loop 46 and rotating. This effectively locks the bedframe support 1 between the hasp 18 and the first housing 10.

The first and second housings 10 and 12 have two other mutually shared hinges 46 and 48 which attach to the opposing triangular sides of each housing. The shared hinges 46 and 48 are comprised of metal tabs each joined together to rotate about a common center on one end and at their other end joined to both housings about midway between the end of the housings' triangular sides. The design of these hinges 46 and 48 is commonly known in the art of hinge design. The shared hinges prevent the second housing from rotating about the first hinge means more than a predetermined amount. The predetermined amount is established so that the second housing will be perpendicular to the first housing when the lockbox is in its furthest most open position.

The lighting means 22 when activated casts light on the access code panel 24. As shown in FIG. 5, the lighting means comprises a light bulb 50, a light bulb holder 52, a lens 54, a reflector 56, batteries 58, and a contact spring 60 connected to a contact surface 62. The reflector 56 and lens 54 extend above the access code panel 24 wherein the bulb 50 is within the reflector. The bulb 50 when lighted shines out through the lens 54 of the reflector 56 to light the access code panel 24. The light is activated by the touch of the access code panel 24 with the hand. Such a switch means is commonly used with other types of lamps and such a contact switch activated by touch or acoustically will not be further herein discussed as no inventive claim is made thereto separate and apart from the herein described invention.

Finally, the inside chamber 47 may be fitted with a soft material 57, such as foam rubber contoured to the shape of a handgun. This helps hold the handgun in a stable position within the lockbox 8, as well as to protect the handgun from scratches.

It should be appreciated from the foregoing description that the present invention provides an improved gun lockbox. It is simple in construction, yet completely effective in securing a loaded handgun, preventing it from being carried away, and allowing quick access to anyone with the proper code, even at night. Moreover, it can serve as an ordinary carrying case for a handgun when not locked to a bedframe support. Additionally, the hasp, free to rotate about the second hinge means serves as a handle.

Although the present invention has been described in detail with reference only to the presently-preferred embodiment, it will be appreciated by those of ordinary skill in the art that various modifications may be made without departing from the essence of the invention and all such modifications and intended to be covered by the appended claims.

I claim:

1. A handgun lockbox to prohibit unauthorized access to a handgun contained therein, the lockbox comprising:

first hinge means;

complementary housings having complementary sides joined together by said first hinge means, wherein said housing form a chamber therebetween sufficient to hold the handgun within when said housings are in a closed position to prevent the hand gun's removal;

first latch means for locking adjacent sides of said complementary housings to lock said complementing housings together preventing access to said chamber therebetween, wherein said first latch means is adapted to prevent unauthorized access to said chamber;

second latch means for releasably securing said housing to a stationary object adapted to prevent unauthorized removal of said housings from said object, and wherein said second latch means retains one of said complementary housings in an upright position to readily expose the handgun within said housings when said housings are in an open position.

2. A lockbox as defined in claim 1, wherein, said first hinge means is spring loaded or incorporates a means interconnected between said housings for causing said housing to pop open when said first latch means has been released causing said housings to separate a predetermined degree.

3. A lockbox as defined in claim 2, wherein, said complementary housings are of a shape and design such that the weight of the handgun on one of said housings causes one of said housings to rotate about said first hinge means creating said open position when said first latch means is released.

4. A lockbox as defined in claim 3, wherein, said first latch means includes a means for lighting said latch means, wherein said lighting means is activated by touch.

5. A lockbox as defined in claim 4, wherein, said second latch means comprising a hasp joined to one of said housings by a second hinge means, wherein said hasp is of a length and geometric shape to fit around a standard bedframe lengthwise support, wherein said hasp can rotate around said second hinge means to hold the bedframe lengthwise support between said hasp and one of said housings, and wherein said hasp further comprising:

a free end defining a slot;

means on a surface of said one of said housings for mating with said slot on said hasp to lock the bedframe lengthwise support between said hasp and said one of said housings.

6. A lockbox as defined in claim 4, wherein, an inside surface of said housings is lined with a soft material conforming to the shape of the handgun within said housings.

7. A gun lockbox or the like comprising the combination:

a first and second housing member hingedly secured and defining therebetween a chamber sufficient in size and configuration to contain a gun or the like;

a latching means for securing to one of said first and second housing members to releasably secure said members to a stationary object, wherein said latching means holds said members in an upright position to readily expose the gun within said chamber when said members are in an open position; and locking means operatively associated with said first and second housing members and adapted to prevent unauthorized access to said chamber, wherein the gun or the like is securely retained within said chamber.

8. A lockbox as defined in claim 7, wherein, said first and second housing members are of a shape and design such that the weight of the handgun or the like on said first member causes said first member to rotate relative to said second member, thereby separating said members when said locking means is in an open position.

9. A lockbox as defined in claim 8, wherein, said hinge means is spring loaded comprising a means interconnected between both housing members for causing said members to pop open when said locking means is unlocked causing said members to open to a predetermined degree.

10. A lockbox as defined in claim 9, wherein, said locking means further comprising a lighting means for lighting said locking means, wherein said lighting means is activated by touch.

11. A lockbox as defined in claim 10, wherein, an inside surface of said housing members is lined with a soft material conformed to the handgun or the like.

* * * * *

UNITED STATES PATENT AND TRADEMARK OFFICE

CERTIFICATE OF CORRECTION

PATENT NO. : 4,788,838

DATED : December 6, 1988

INVENTOR(S) : Daniel M. Cislo

It is certified that error appears in the above-identified patent and that said Letters Patent is hereby corrected as shown below:

In Column 2, line 19 delete "o" and insert -- on -- thereof;

In Column 2, line 46 delete "ca" and insert -- can -- thereof;

In Claim 1 at Column 4, line 48 delete "housing" and insert -- housings -- thereof.

Signed and Sealed this

Seventh Day of March, 1989

*Attest:*

*Attesting Officer*

DONALD J. QUIGG

*Commissioner of Patents and Trademarks*